United States Patent [19]

Akazawa

[11] Patent Number: 4,836,460

[45] Date of Patent: Jun. 6, 1989

[54] SCREW MILL

[75] Inventor: Toyo Akazawa, Ageo, Japan

[73] Assignee: Japan M&C Trading Co., Ltd., Japan

[21] Appl. No.: 121,358

[22] Filed: Nov. 16, 1987

[30] Foreign Application Priority Data

Apr. 14, 1987 [JP] Japan ..... 62-91346

[51] Int. Cl.[4] ..... B02C 23/02

[52] U.S. Cl. ..... 241/247; 198/662; 241/101 D; 241/259.1; 241/260.1; 241/261.1; 241/285 A; 241/286; 366/76; 366/89; 366/90; 366/323

[58] Field of Search ..... 241/46.02, 46.04, 46.06, 241/247, 259.1, 259.2, 260.1, 261.1, 286, 42, 45, 101 B, 101 D, 101.2, 101.6, 152 A, 155, 157, 159, 160, 163, 251, 260, 285 A; 198/661, 662, 670, 676; 366/76, 88, 89, 90, 323, 322

[56] References Cited

U.S. PATENT DOCUMENTS

| | | | |
|---|---|---|---|
| 61,262 | 1/1867 | Rose | 241/46.02 |
| 2,884,145 | 4/1959 | Müller et al. | 198/676 X |
| 3,232,419 | 2/1966 | Rasmussen | 198/670 X |
| 3,348,780 | 10/1967 | Barkstrom et al. | 241/101.6 |
| 3,384,138 | 5/1968 | Johnson et al. | 241/247 |
| 3,652,064 | 3/1972 | Lehnen et al. | 198/676 X |
| 3,868,093 | 2/1975 | Sokolow | 366/76 |
| 4,249,703 | 2/1981 | Koreneu et al. | 241/247 |

*Primary Examiner*—Joseph M. Gorski

*Attorney, Agent, or Firm*—Mason, Fenwick & Lawrence

[57] ABSTRACT

A screw mill, for example, used for producing fine powder grains of calcium carbonate used as a bulking agent for paper. According to the screw mill of the present invention, the combination of the continuous screw and discontinuous vanes makes it possible to efficiently grind both slurry and dry materials without causing clogging of the mill. Also the clearance between the hub and the rotor can be finely adjusted by the screw type adjustor. This makes it possible to easily adjust the grain size and to produce ground materials having the spheroidicity of 0.3–0.03 which is best suited for use as a bulking agent for paper.

5 Claims, 3 Drawing Sheets

SCREW MILL

BACKGROUND OF THE INVENTION

This invention relates to a screw mill and more particularly to a screw mill used for producing, for example, powder of calcium carbonate used as a bulking agent for paper.

Heretofore, several systems for grinding particles of small diameter have been known; which include, for example, the following:

(1) an impact and pressure-type system; this type of system is carried out, for example, by using a jaw crusher or an impact crusher;

(2) a pressure and shearing type system; this type of system is carried out, for example, by using a roller mill;

(3) an autogenous grinding type system, (for example, striking, pressing, rolling, and high speed rolling and impacting type system); this type of system is carried out by using an aerofall mill, a jet mill, a rolling cylinder mill, an attrition mill or a super-micron mill;

(4) a type of system which uses a grinding medium; this type of system is carried out by using a ball mill, a rod mill, a vibration ball mill or an attrition mill;

(5) a combination of the system types (1)–(4).

However, none of these types of systems can easily control the grain size nor can they manufacture powder grains each having spheroidicity of less than 0.3 which is necessary to be suitable for use as a bulking agent for paper.

SUMMARY OF THE INVENTION

It is an object of the present invention to provide a screw mill which can grind or abrade not only slurry materials but also dry materials without causing clogging of the mill and which can easily control grain size and also can obtain powder grains each having spheroidicity of less than 0.3.

The spheroidicity A of each powder grain is defined as follows:

$$A = \frac{\overline{m}}{\overline{m'}}$$

where "m" is observation mass of one grain;

The observation mass of one grain "m" is found by detecting the number of grains included in a sample of predetermined weight by means of a particle counter using the electrical resistance method (Caulter's principle) and then by dividing the weight by the number of grains.

The value "m'" is the mass of one grain assumed as spherical and calculated from a volumetric mean diameter (d') of a cubic formed by surfaces each being tangential to the grain. This is calculated as follows:

$$\overline{m'} = \frac{\pi}{6}(\overline{d'})^3 \rho$$

$$\rho = 2.7\ (\mathrm{g/cm^3})$$

$$\overline{d'} = \left\{ \frac{1}{n} \cdot \sum_{i=1}^{n} (d'\ i)^3 \right\}^{\frac{1}{3}}$$

where, "d'" is found by an image analysis system.

Thus, the spheroidicity A of a sphere is 1, and the spheroidicity A of a coin-shaped grain having a thickness of 1/10 diameter is 0.15.

According to the present invention, a screw mill is provided comprising: a hollow cylindrical member having first and second inlet ports respectively for slurry and dry materials to be milled, the first and second inlet ports being arranged respectively at the rear and front sides of the cylindical member, and the materials to be milled being transferred from the rear side toward the front side of the cylindrical member during the milling operation carried out therein; a shaft member having a diameter gradually increasing toward the front of the cylindrical member and formed with a continuous screw extending from the first inlet port to a position just before the second inlet port and also formed with vanes of multiple stages arranged at the front of the continuous screw, the shaft member being arranged within the hollow cylindrical member so that the continuous screw and the vanes are in contact with the inner cylindrical surface of the hollow cylindrical member; a forwardly diverging rotor secured to the front end of the shaft member and formed on the outer periphery thereof with grooves inclined relative to an axis of the shaft member; a hub member secured to the front end of the hollow cylindrical member around the rotor and having a forwardly diverging inner perpheral surface shaped complementary to the outer periphery of the rotor, the inner peripheral surface of the hub member being formed with grooves facing to the grooves of the rotor; a driving means for rotating the shaft member around its axis; and a pressure applying means for sliding the hub member together with the hollow cylindrical member along the axis of the shaft member so as to urge the hub member against the rotor.

BRIEF DESCRIPTION OF THE INVENTION

Other objects and advantages of the present invention will become apparent from the following detailed description of the preferred embodiment of the present invention taken in reference to the accompanying drawings in which.

DESCRIPTION OF THE PREFERRED EMBODIMENT

Figure 1:
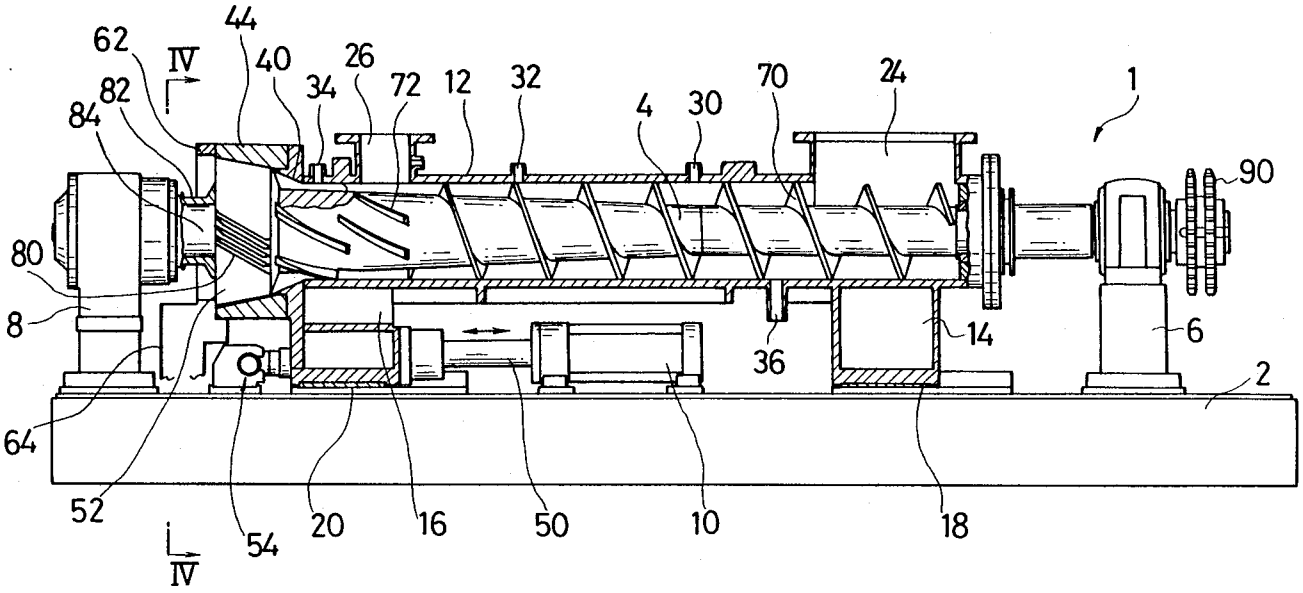
FIG. 1 is a cross-sectional side elevation view of the preferred embodiment of the screw mill of the present invention.

As shown in FIG. 1, a screw mill 1 has a base 2 on which a first bearing unit 6 and a second bearing unit 8 for rotatably supporting a shaft member 4 are mounted the right and left sides, respectively. Also mounted on the base 2 is a hydraulic cylinder unit 10 for driving a hollow cylindrical member 12 axially along the base 2.

Figure 4:
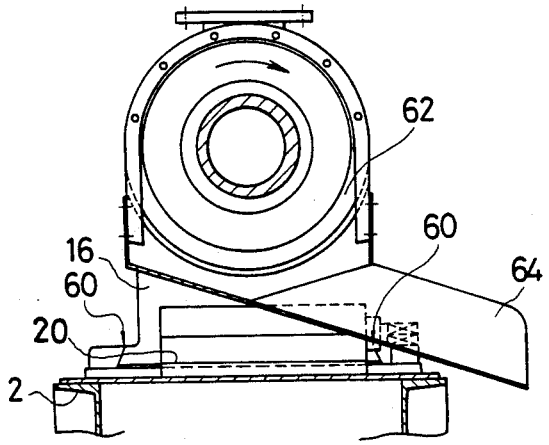
FIG. 4 is a cross-sectional view taken along the line IV—IV of FIG. 1.

The hollow cylindrical member 12 is slidably supported on the base 2 via supporting units 14 and 16 and slide plates 18 and 20. The sliding motion of the cylindrical member 12 is guided, for example, by a dove-tail guiding means 60 (FIG. 4).

The cylindrical member 12 is provided with a first inlet port 24 for slurry materials and a second inlet port 26 for dry materials at the rear and front sides of the cylindrical member 12, respectively. The materials to be ground flow from their inlet ports 24 and 26 toward the front of the screw mill 1 (i.e. toward the left-hand side of FIG. 1). When slurry materials are to be ground, they are fed into the screw mill 1 through the first inlet port 24, while dry materials are fed through the second inlet port 26 when dry materials are to be ground. Two inlet ports 30 and 32 for dispersing agent are formed on the top of the cylindrical member 12 between the first and second inlet ports 24 and 26 and another inlet port 34 for the dispersing agent is formed in front of the second inlet port 26. A drain 36 for washing water is also formed on the bottom of the cylindrical member 12.

Figure 2:
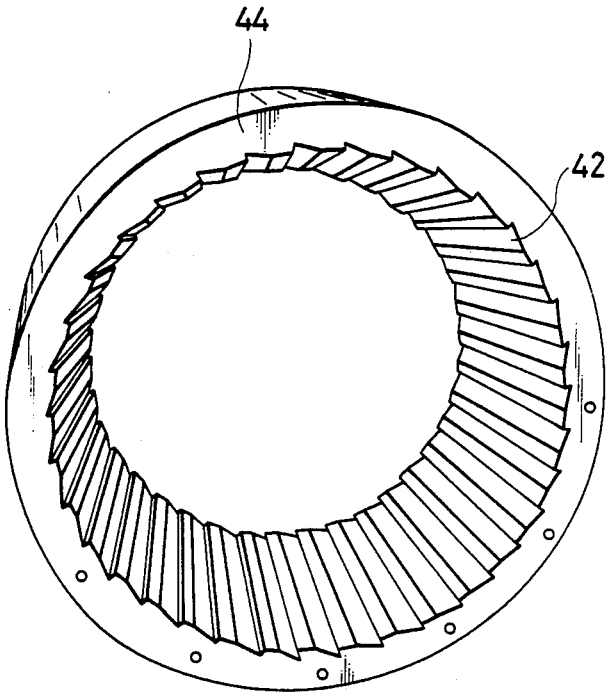
FIG. 2 is a perspective view of a hub used in the screw mill of FIG. 1.

A forwardly diverging taper portion 40 is formed on the inner surface of the front end of the cylindrical member 12. A hub member 44 is secured to the front end of the hollow cylindrical member 12. The hub 44 has a forwardly diverging inner peripheral surface and is formed with grooves 42 (FIG. 2) on the inner peripheral surface thereof. A drainer ring 62 for receiving the ground powder is mounted on the front end of the hub 44, and a chute 64 for taking out and guiding the ground powder to one side of the screw mill 1 is mounted below the drainer ring 62.

Figure 3:
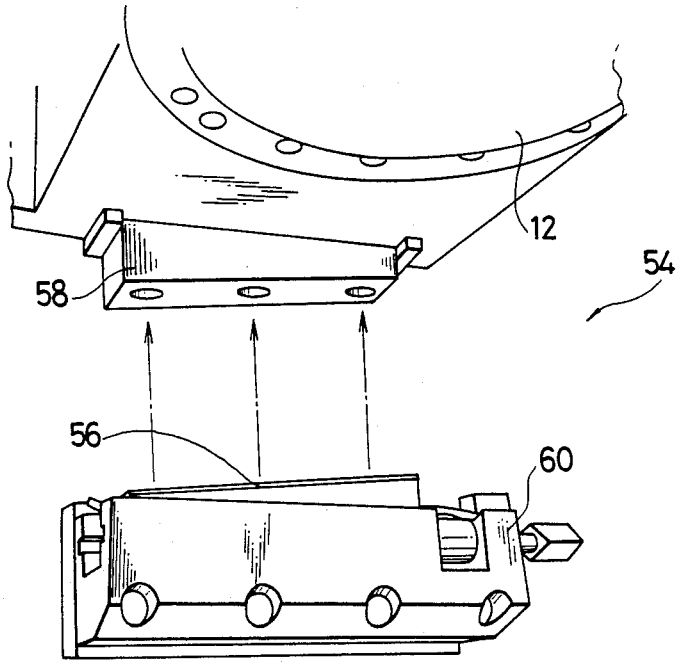
FIG. 3 is a perspective view showing an exploded view of a clearance adjusting apparatus used in the screw mill of FIG. 1.

The rear end of the front supporting unit 16 is connected to the front end of a plunger 50 of the hydraulic cylinder 10. A clearance adjusting apparatus 54 is connected to the supporting unit 16 so as to finely adjust the clearance between the hub 44 and a rotor 52 which will be hereinafter explained. As shown in FIG. 3, the clearance adjusting apparatus 54 is composed of a pair of tapered members 56 and 58 and a screw means 60 for moving the tapered member 56 along a line perpendicular to the axis of the cylindrical member 12.

The shaft member 4 is rotatably supported within the hollow cylindrical member 12 and has a diameter gradually increasing toward the front of the screw mill 1. The shaft member 4 is provided with a continuous helical screw 70 extending from the first inlet port 24 to a position just before the second inlet port 26 and also provided with discontinuous vanes 72 divided into two vane portions in the preferred embodiment of FIG. 1) arranged in a region in front of the continuous screw 70. The height of the screw 70 and the vanes 72 are so determined that the crests thereof contact the inner surface of the cylindrical member 12. The vanes 72 of the front stage gradually increase in height so that the crests thereof contact the inner surface of the tapered portion 40 of the cylindrical member 12.

The rotor 52 is secured to the front end of the shaft member 4 and has grooves 80 formed on the periphery thereof. The direction of the helix of the grooves 80 is the same as that of the vanes 72. The front end of the rotor 52 is secured to a shaft 84 rotatably mounted on the second bearing unit 8 and the draining groove member 82 is mounted around the shaft 84.

The operation of the screw mill of the present invention will now be described. Prior to the grinding operation, the clearance between the hub 44 and the rotor 52 is adjusted by the screw means 60 and the hydraulic cylinder unit 10 is operated to urge the hub 44 against the rotor 52 at a predetermined pressure. The shaft member 4 is then rotated by a power source (not shown) via a chain (not shown) and a sprocket wheel 90. If the materials to be ground are liquid of slurry, they are fed into the first inlet port 24. On the other hand, if the materials to be ground are dry particles, they are fed into the second inlet port 26. The dispersing agents are fed into the ports 30, 32 and 34, if desired.

Slurry materials fed into the first inlet port 24 are pressed to a condition of high density and reduced volume while they are passed forward through a space between the cylindrical member 12 and the shaft member 4 having a gradually increasing diameter toward the front. The materials are then jammed into the clearance between the hub 44 and the rotor 52 by the multi-stage vanes 72 and ground therebetween and finally taken out from the screw mill 1 through the chute 64. On the other hand, dry materials fed into the second inlet port 26 are jammed into the clearance between the hub 44 and the rotor 52 by the multistaged vanes 72 and ground into fine powder therebetween and finally taken out from the screw mill 1 through the chute 64.

According to the screw mill of the present invention, the combination of the continuous screw and discontinuous vanes makes it possible to efficiently grind both slurry and dry materials without causing clogging of the mill. Also, the clearance between the hub and the rotor can be finely adjusted by the screw type adjustor. This makes it possible to easily adjust the grain size and to produce ground materials having the spheroidicity of 0.3–0.03 which is best suited for a bulking agent for paper.

What is claimed is:

1. A screw mill comprising:

a hollow cylindrical member having first and second inlet ports respectively for slurry and dry materials to be milled, the first and second inlet ports being arranged respectively at the rear and front sides of the cylindrical member, the materials to be milled being transferred through the front side of the cylindrical member during the milling operation thereof;

a shaft member having a diameter gradually increasing from the rear side toward the front side of the cylindrical member and formed with a continuous screw extending from the first inlet port to a position just before the second inlet port, and also formed with discontinuous vanes arranged at the front side of the cylindrical member and in front of the continuous screw, the shaft member being arranged within the hollow cylindrical member so that the continuous screw and the vanes are in contact with the inner cylindrical surface of the hollow cylindrical member;

a forwardly diverging rotor secured to the front end of the shaft member and formed on the outer periphery thereof with grooves inclined relative to an axis of the shaft member;

a hub member secured to the front end of the hollow cylindrical member around the rotor and having a forwardly diverging inner peripheral surface shaped complementary to the outer periphery of the rotor, the inner peripheral surface of the hub member being formed with grooves facing the grooves of the rotor;

a driving means for rotating the shaft member around its axis; and, a pressure applying means for sliding the hub member together with the hollow cylindrical member along the axis of the shaft member so as to urge the hub member against the rotor.

2. The screw mill according to claim 1 wherein said vanes are discontinuously arranged in two stages.

3. The screw mill according to claim 1 wherein said pressure applying means comprises a hydraulic cylinder for sliding the cylindrical member along the axis of the shaft member.

4. The screw mill according to claim 1 wherein said screw mill further includes a screw type clearance adjusting apparatus for adjusting a clearance between the hub member and the rotor.

5. The screw mill according to claim 4 wherein said screw type clearance adjusting apparatus comprises first and second tapered members and a screw means for moving said first member along a line perpendicular to an axis of the cylindrical member.

* * * * *